US009552776B2

(12) United States Patent
Lee et al.

(10) Patent No.: US 9,552,776 B2
(45) Date of Patent: Jan. 24, 2017

(54) LUMINANCE COMPENSATION APPARATUS FOR ORGANIC LIGHT EMITTING DIODE PANEL

(71) Applicant: SiliconFile Technologies Inc., Seongnam-si, Gyeonggi-do (KR)

(72) Inventors: Do-Young Lee, Seongnam-si (KR); Jae-Won Uhm, Suwon-si (KR)

(73) Assignee: SILICONFILE TECHNOLOGIES INC., Gyeonggi-do (KR)

( * ) Notice: Subject to any disclaimer, the term of this patent is extended or adjusted under 35 U.S.C. 154(b) by 232 days.

(21) Appl. No.: 14/369,214

(22) PCT Filed: Dec. 26, 2012

(86) PCT No.: PCT/KR2012/011441

§ 371 (c)(1),
(2) Date: Jun. 27, 2014

(87) PCT Pub. No.: WO2013/100545

PCT Pub. Date: Jul. 4, 2013

(65) Prior Publication Data

US 2015/0042694 A1 Feb. 12, 2015

(30) Foreign Application Priority Data

Dec. 30, 2011 (KR) ..... 10-2011-0147206

(51) Int. Cl.
*G09G 3/30* (2006.01)
*G09G 3/32* (2016.01)
*G09G 3/20* (2006.01)

(52) U.S. Cl.
CPC ..... *G09G 3/3283* (2013.01); *G09G 3/2003* (2013.01); *G09G 3/3225* (2013.01); *G09G 3/30* (2013.01); *G09G 3/3208* (2013.01); *G09G 3/3233* (2013.01); *G09G*
(Continued)

(58) Field of Classification Search
CPC ..... G09G 3/3208; G09G 3/3233; G09G 2320/045; G09G 2320/043; G09G 3/30
(Continued)

(56) References Cited

U.S. PATENT DOCUMENTS 7,321,348 B2 * 1/2008 Cok ..... G09G 3/3225 345/208
8,339,386 B2 * 12/2012 Leon ..... G09G 3/30 345/207
(Continued)

FOREIGN PATENT DOCUMENTS

CN 101996554 3/2011
JP 10-282924 10/1998
(Continued)

OTHER PUBLICATIONS

International Search Report for International Application No. PCT/KR2012/011441, dated May 3, 2013.
(Continued)

*Primary Examiner* — Chanh Nguyen
*Assistant Examiner* — Yuzhen Shen
(74) *Attorney, Agent, or Firm* — I P & T Group LLP

(57) ABSTRACT

Disclosed is a luminance compensation apparatus of an organic light emitting diode panel including a reference pixel element unit that is installed at an outer peripheral portion of a display area on an organic light emitting diode panel and operate corresponding to a pixel element aligned in the display area, and a driving chip that is provided in an area including the reference pixel element unit of the outer peripheral portion of the display area, compares a luminance value of light incident from the reference pixel element unit with a reference luminance value to calculate a luminance deviation value based on a comparison result, controls driving of pixel elements aligned in the display area accord-
(Continued)

ing to the luminance deviation value, and allows light, luminance deviation of which has been compensated, to be irradiated.

9 Claims, 3 Drawing Sheets

(52) U.S. Cl.
CPC ..... 2320/029 (2013.01); *G09G 2320/0233* (2013.01); *G09G 2320/041* (2013.01); *G09G 2320/0626* (2013.01); *G09G 2320/0666* (2013.01); *G09G 2360/145* (2013.01)

(58) Field of Classification Search
USPC ..... 345/76, 77, 207
See application file for complete search history.

(56) References Cited

U.S. PATENT DOCUMENTS 8,493,294 B2 * 7/2013 Yamashita ..... G09G 3/3233 313/500
2010/0020051 A1 * 1/2010 Kim ..... G09G 3/3233 345/207
2011/0273111 A1 * 11/2011 Park ..... G09G 3/3233 315/294
2011/0298782 A1 12/2011 Park

FOREIGN PATENT DOCUMENTS

| | | |
|---|---|---|
| JP | 2007-156044 | 6/2007 |
| JP | 2007-264307 | 10/2007 |
| JP | 2008-122516 | 5/2008 |
| KR | 10-2004-0101905 | 12/2004 |
| KR | 10-2011-0020730 | 3/2011 |

OTHER PUBLICATIONS

Notification of the First Office Action issued by the State Intellectual Property Office of the People's Republic of China on Sep. 25, 2015.
Office Action issued by the Japanese Intellectual Property Office on Nov. 8, 2016.

* cited by examiner

LUMINANCE COMPENSATION APPARATUS FOR ORGANIC LIGHT EMITTING DIODE PANEL

BACKGROUND OF THE INVENTION

Field of the Invention

The present invention relates to a technology for compensating for a change in the luminance of an organic light emitting diode (OLED) panel, and more particularly, to a luminance compensation apparatus of an organic light emitting diode panel, in which a driving chip installed at an outer peripheral portion of an organic light emitting diode panel calculates luminance deviation by using reference pixels installed at an adjacent position, and compensates for luminance for pixel elements aligned in a display area.

Description of the Related Art

An OLED panel is a display panel that electrically excites fluorescent or phosphorescent organic material to emit light, and has been spotlighted as a next generation display panel because it has superior definition and contrast range and can be manufactured in the form of an ultra thin film.

In general, the OLED panel includes a plurality of scan lines, a plurality of data lines, a driving line for transferring a driving voltage, and a plurality of display pixels.

A driving scheme of the OLED panel is largely classified into an analog driving scheme and a digital driving scheme. In the analog driving scheme, a light emitting voltage or a light emitting current supplied to an OLED is adjusted to represent display data. In the digital driving scheme, a time of a light emitting voltage or a light emitting current supplied to an OLED is adjusted to represent display data. In a constant voltage driving scheme, a constant driving voltage is supplied to a driving node of a pixel, and in a constant current driving scheme, a constant driving current is supplied to a driving node of a pixel. In all the constant voltage driving scheme and the constant current driving scheme, luminance of light emitted from an OLED corresponds to display data.

In the constant current driving scheme, since a constant driving current is supplied to the OLED, a light emitting current is almost constant and a change in the luminance of the OLED is small, but there is a problem that luminance is not uniform due to position deviation of a constant current source that supplies the constant driving current. In the constant voltage driving scheme, there is no problem that luminance is not uniform, but even though a constant driving voltage is supplied, since a light emitting current is not constant, a change in the luminance of the OLED is relatively large. For example, when temperature is changed, even though a light emitting voltage is constant, a light emitting current is changed, resulting in a change in the luminance of the OLED.

In addition, due to deviation or experience change of a manufacturing process of the OLED panel, the luminance of the OLED panel has target luminance and deviation. Such luminance deviation degrades the display quality of the OLED panel.

In a conventional OLED panel driving apparatus, luminance is indirectly detected based on a driving current or a threshold voltage of an OLED, and then luminance deviation is calculated and compensated.

When the luminance is indirectly detected as described above, a detection process is complicated and the accuracy is reduced.

SUMMARY OF THE INVENTION

Accordingly, the present invention has been made in an effort to solve the problems occurring in the related art, and an object of the present invention is to allow a driving chip installed at an outer peripheral portion of an OLED panel to calculate luminance deviation for pixel elements aligned in a display area by using reference pixels installed at an adjacent position, and to compensate for luminance.

In order to achieve the above object, according to one aspect of the present invention, there is provided a luminance compensation apparatus of an organic light emitting diode panel including: a reference pixel element unit that is installed at an outer peripheral portion of a display area on an organic light emitting diode panel and operate corresponding to a pixel element aligned in the display area; and a driving chip that is provided in an area including the reference pixel element unit of the outer peripheral portion of the display area, compares a luminance value of light incident from the reference pixel element unit with a reference luminance value to calculate a luminance deviation value based on a comparison result, controls driving of pixel elements aligned in the display area according to the luminance deviation value, and allows light, luminance deviation of which has been compensated, to be irradiated.

The driving chip includes: an optical sensor that is installed at a position facing the reference pixel element unit, detects light incident from the reference pixel element unit, and outputs a luminance detection signal based on the detected light; a comparator that compares a luminance detection value input from the optical sensor with the reference luminance value and outputs a luminance deviation value based on a comparison result; and a luminance control unit that outputs a luminance deviation compensation control signal for controlling driving of the pixel elements according to the luminance deviation value output from the comparator.

In accordance with the present invention, reference pixels having the same configurations as those of pixel elements aligned in a display area on an organic light emitting diode panel are installed at positions adjacent to a driving chip installed at an outer peripheral portion of the organic light emitting diode panel, and the driving chip calculates luminance deviation of the pixel elements aligned in the display area by using the reference pixels to compensate for luminance, so that a luminance detection process is simple and the accuracy of luminance deviation compensation can be ensured.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
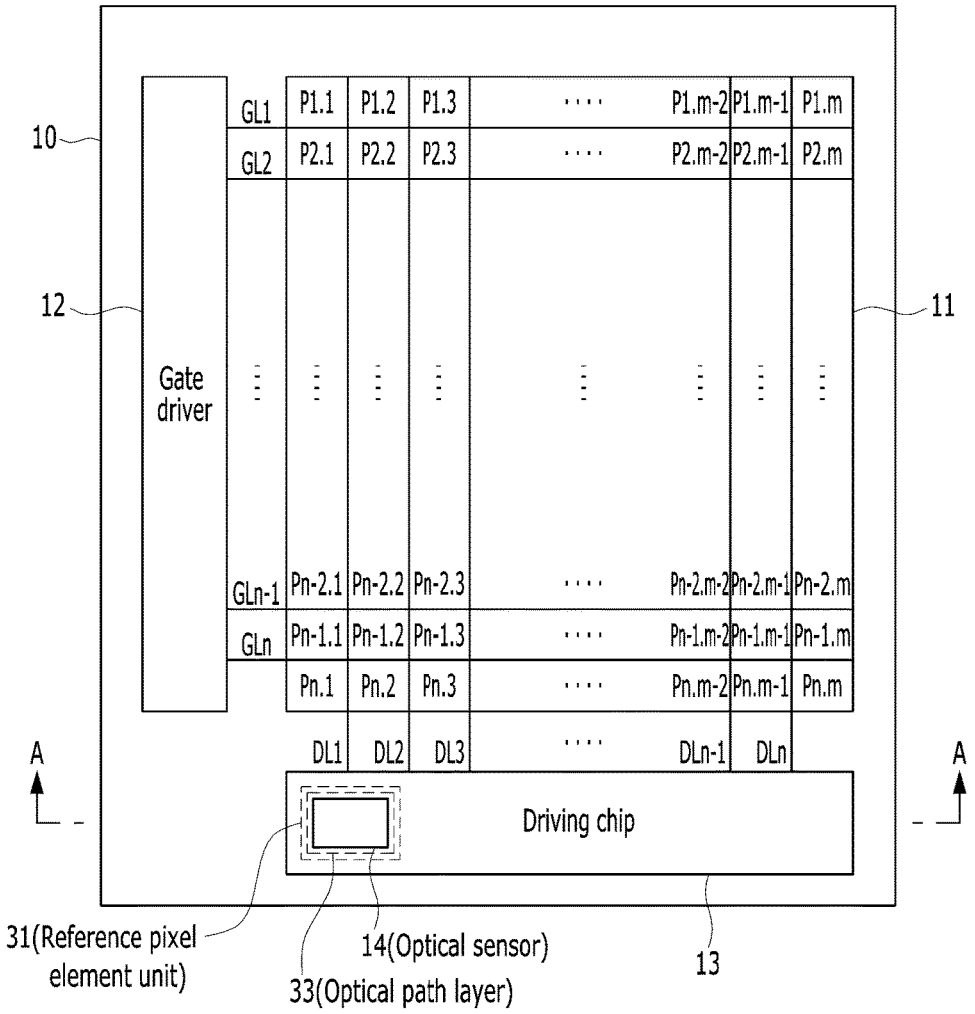
FIG. 1 is a plan view of a luminance compensation apparatus of an organic light emitting diode panel according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a plan view of a luminance compensation apparatus of an organic light emitting diode panel according to the present invention.

As illustrated in FIG. 1, the luminance compensation apparatus of an organic light emitting diode panel according to the present invention includes a display area 11, a gate driver 12, a driving chip 13, an optical sensor 14, an optical path layer 33 and a reference pixel element unit 31 on an organic light emitting diode panel 10.

The display area 11 includes pixel elements P1.1 to Pn.m at crossing sections of gate lines GL1 to GLn and data lines DL1 to DLm aligned to cross each other.

The pixel elements P1.1 to Pn.m aligned as described above are driven when gate signals supplied through the gate lines GL1 to GLn are enabled and emit light corresponding to the amplitude of a pixel signal supplied through the data lines DL1 to DLm.

In order to drive the pixel elements P1.1 to Pn.m aligned in the display area 11 of the organic light emitting diode panel 10, output terminals of the gate driver 12 are connected to the gate lines GL1 to GLn, respectively, and output terminals of a source driver in the driving chip 13 are connected to the data lines DL1 to DLm, respectively.

Figure 2:
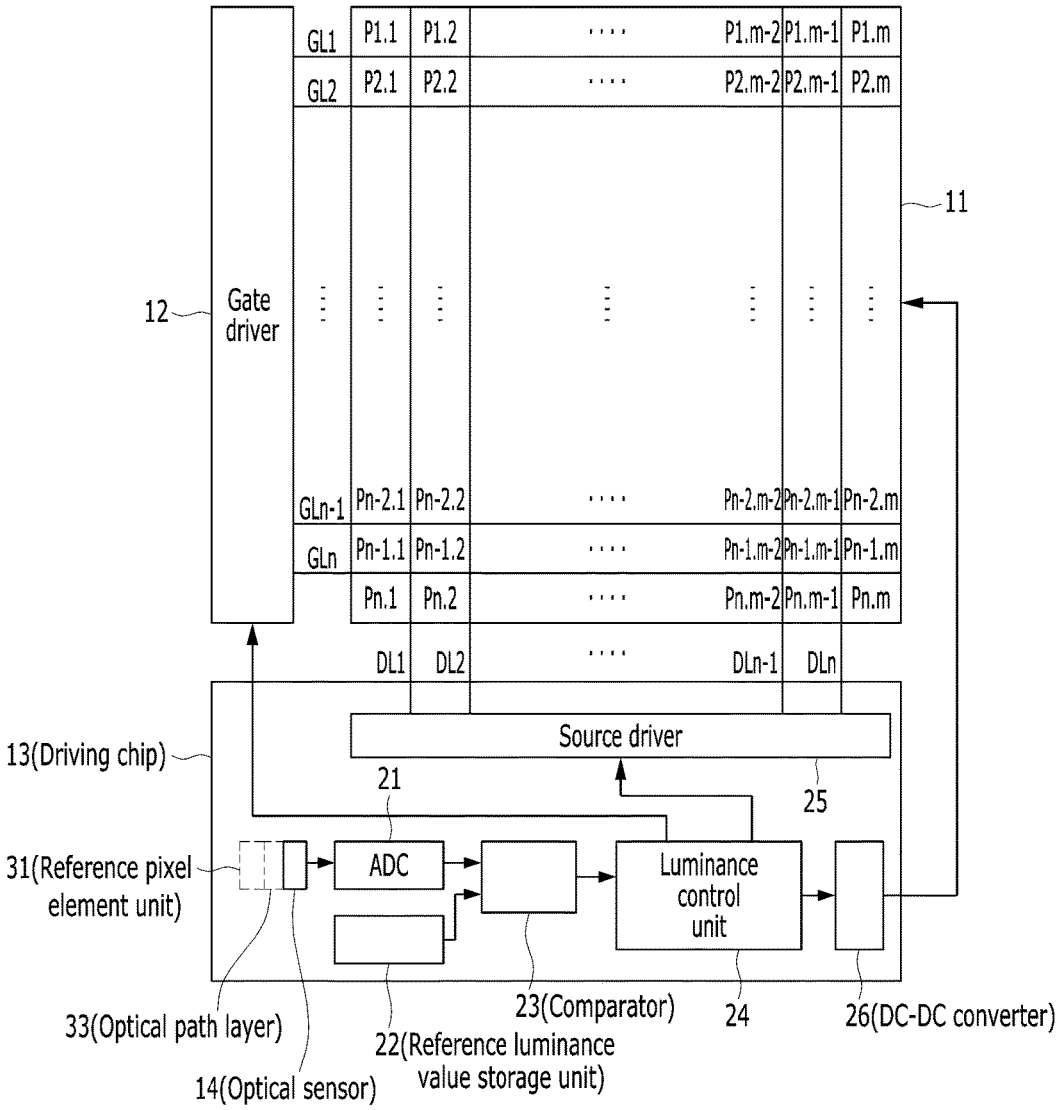
FIG. 2 is a block diagram of a luminance compensation apparatus of an organic light emitting diode panel according to the present invention.

FIG. 2 is a block diagram of the luminance compensation apparatus of the organic light emitting diode panel according to the present invention.

As illustrated in FIG. 2, the driving chip 13 according to the present invention includes an optical sensor 14, an optical path layer 33, a reference pixel element unit 31, an analog to digital converter (ADC) 21, a reference luminance value storage unit 22, a comparator 23, a luminance control unit 24, a source driver 25, and a DC-DC converter 26.

The optical sensor 14 is installed in the driving chip 13, and is installed at a position facing a reference pixel element unit installed an outer peripheral portion of the display area 11 on the organic light emitting diode panel 10.

Figure 3:
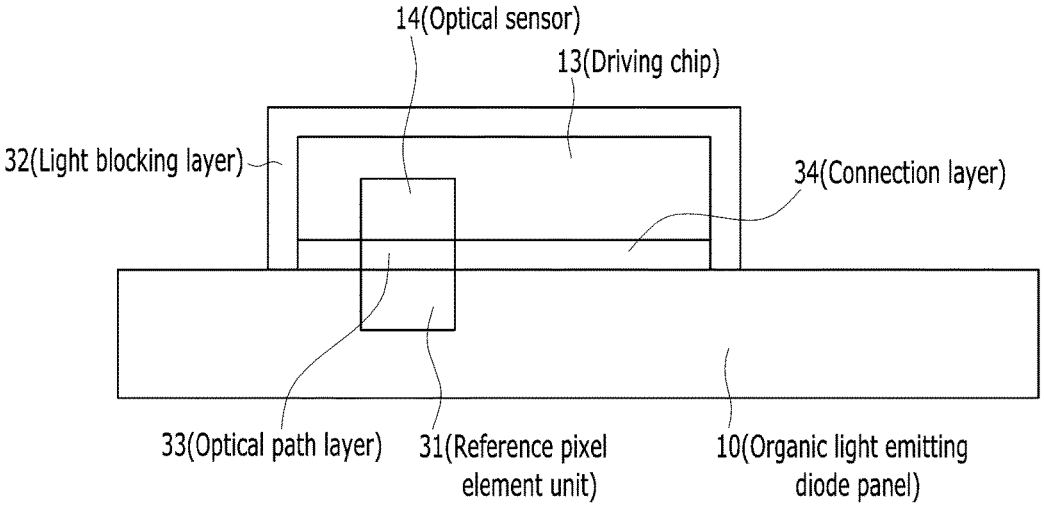
FIG. 3 is a sectional view taken along line A-A of FIG. 1.

FIG. 3 is a sectional view taken along line A-A of FIG. 1.

Referring to FIG. 3, a reference pixel element unit 31 is formed at an outer peripheral portion of the display area 11 on the organic light emitting diode panel 10, wherein an upper surface of the reference pixel element unit 31 is formed to be exposed to an upper surface of the organic light emitting diode panel 10. The driving chip 13 is provided at the outer peripheral portion of the display area 11 on the organic light emitting diode panel 10, and the optical sensor 14 is formed at a position corresponding to the upper surface of the reference pixel element unit 31 in the driving chip 13. For optical sensing of the optical sensor 14, an optical path layer 33 is formed between the upper surface of the reference pixel element unit 31 and a lower surface of the optical sensor 14 and serves as an optical path. In order to prevent light generated in the reference pixel element unit 31 from being irradiated in a direction other than the optical sensor 14 or prevent external light from being incident into the optical sensor 14, a light blocking layer 32 is formed to surround portions except for a bottom surface of the outer peripheral portion of the driving chip 13. The optical path layer 33 is surrounded by a connection layer 34 of the organic light emitting diode panel 10 and the driving chip 13.

The reference pixel element unit 31 is formed in order to detect the degree (luminance deviation) by which luminance of the pixel elements P1.1 to Pn.m aligned in the display area 11 of the organic light emitting diode panel 10 deviates from target luminance.

Accordingly, it is preferable that an OLED, a transistor, and a capacitor, which are elements of the reference pixel element unit 31, are equal to or very similar to the elements of the pixel elements P1.1 to Pn.m. The reference pixel element unit 31 may be a single pixel corresponding to one of red (R), green (G), and blue (B), or pixels corresponding to all of the red (R), the green (G), and the blue (B).

The reference pixel element unit 31 is driven by the driving chip 13. The driving chip 13 may drive the reference pixel element unit 31 in various methods. In an example, the driving chip 13 may drive the reference pixel element unit 31 according to driving data and a control signal programmed in advance. In another example, the driving chip 13 may drive the reference pixel element unit 31 such that the reference pixel element unit 31 corresponds to one of the pixel elements P1.1 to Pn.m. In further another example, the driving chip 13 may calculate an average of driving data of a plurality of pixel elements aligned at arbitrary positions among the pixel elements P1.1 to Pn.m, and drive the reference pixel element unit 31 by the average data.

Light generated from the reference pixel element unit 31 is irradiated to the optical sensor 14 through the optical path layer 33. As described above, since the reference pixel element unit 31 and the optical path layer 33 are surrounded by the light blocking layer 32, the light generated from the reference pixel element unit 31 is irradiated to the optical sensor 14 without being leaked to the outside, and external light is not irradiated to the optical sensor 14.

The optical sensor 14 senses the light incident from the reference pixel element unit 31, and outputs a luminance detection signal based on the sensed light.

The analog to digital converter 21 converts the analog luminance detection signal input from the optical sensor 14 into a digital signal, and outputs the digital signal to an input terminal of one side of the comparator 23.

The comparator 23 compares the luminance detection value input from the analog to digital converter 21 with a reference luminance value stored in advance in the reference luminance value storage unit 22, and outputs a luminance deviation value based on the comparison result.

The luminance control unit 24 checks the luminance deviation value input from the comparator 23, and ignores the luminance deviation value if the luminance deviation value is equal to or less than a reference value. However, when the luminance deviation value input from the comparator 23 is determined to be equal to or more than the reference value, the luminance control unit 24 performs a control function of outputting a luminance deviation compensation control signal to compensate for luminance.

There are various control functions for compensating for luminance by the luminance control unit 24. In an example, the luminance control unit 24 controls the driving of the source driver 25 by using a first luminance deviation compensation control signal according to the luminance deviation, and changes the level of a data voltage supplied to the display area 11 through the data line, thereby allowing the luminance of light irradiated from the pixel elements P1.1 to Pn.m to be maintained at a normal level.

In another example, the luminance control unit 24 controls the driving of the gate driver 12 by using a second luminance deviation compensation control signal according to the luminance deviation, and adjusts the driving time of a gate signal supplied to the display area 11 through the gate line so as to adjust the driving time of the pixel elements P1.1 to Pn.m, thereby allowing the luminance of light irradiated from the pixel elements P1.1 to Pn.m to be maintained at a normal level.

In further another example, the luminance control unit 24 controls the driving of the DC-DC converter 26 by using a third luminance deviation compensation control signal according to the luminance deviation, and changes the level of a voltage supplied to the display area 11, thereby allowing the luminance of light irradiated from the pixel elements P1.1 to Pn.m to be maintained at a normal level.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A luminance compensation apparatus of an organic light emitting diode panel, comprising:

a reference pixel element that is installed at an outer peripheral portion of a display area on an organic light emitting diode panel and operates corresponding to a pixel element aligned in the display area; and a driving chip that is provided in an area including the reference pixel element of the outer peripheral portion of the display area, compares a luminance value of light incident from the reference pixel element with a reference luminance value to calculate a luminance deviation value based on a comparison result, controls driving of pixel elements aligned in the display area according to the luminance deviation value, and allows light, luminance deviation of which has been compensated, to be irradiated, wherein the driving chip comprises:

an optical sensor that is installed at a position facing the reference pixel element, detects light incident from the reference pixel element, and outputs a luminance detection signal based on the detected light;

an optical path layer between the reference pixel element and the optical sensor such that the optical sensor is over the optical path layer and the optical path layer is over the reference pixel element;

a connection layer that surrounds the optical path layer in a first direction parallel to a bottom surface of an outer peripheral portion of the driving chip;

a light blocking layer having a first portion that surrounds the reference pixel element and the optical path layer in the first direction, and having a second portion that surrounds the reference pixel element and the optical path layer in a second direction perpendicular to the bottom surface of an outer peripheral portion of the driving chip except for the bottom surface of an outer peripheral portion of the driving chip;

a comparator that compares a luminance detection value input from the optical sensor with the reference luminance value and outputs a luminance deviation value based on a comparison result; and a luminance controller that outputs a luminance deviation compensation control signal for controlling driving of the pixel elements according to the luminance deviation value output from the comparator.

2. The luminance compensation apparatus of an organic light emitting diode panel according to claim 1, wherein the reference pixel element includes a single pixel element corresponding to one of red (R), green (G), and blue (B).

3. The luminance compensation apparatus of an organic light emitting diode panel according to claim 1, wherein the reference pixel element includes pixel elements corresponding to all of red (R), green (G), and blue (B).

4. The luminance compensation apparatus of an organic light emitting diode panel according to claim 1, wherein the reference pixel element is driven according to driving data and a control signal programmed in advance.

5. The luminance compensation apparatus of an organic light emitting diode panel according to claim 1, wherein the reference pixel element is driven by an average of driving data of a plurality of pixel elements aligned at arbitrary positions among the pixel elements aligned in the display area.

6. The luminance compensation apparatus of an organic light emitting diode panel according to claim 1, further comprising:

a source driver that changes a level of a data voltage supplied to the display area through a data line according to the luminance deviation compensation control signal output from the luminance controller, thereby allowing luminance of light irradiated from the pixel elements to be maintained at a normal level.

7. The luminance compensation apparatus of an organic light emitting diode panel according to claim 1, further comprising:

a gate driver that adjusts a driving time of a gate signal supplied to the display area through a gate line according to the luminance deviation compensation control signal output from the luminance controller, thereby allowing luminance of light irradiated from the pixel elements to be maintained at a normal level.

8. The luminance compensation apparatus of an organic light emitting diode panel according to claim 1, further comprising:

a DC-DC converter that changes a level of a direct current voltage supplied to the display area according to the luminance deviation compensation control signal output from the luminance controller, thereby allowing luminance of light irradiated from the pixel elements to be maintained at a normal level.

9. The luminance compensation apparatus of an organic light emitting diode panel according to claim 1, wherein a bottommost portion of the light blocking layer is lower than a bottom of the optical sensor.

* * * * *